United States Patent [19]

Sorrells

[11] Patent Number: 4,535,575

[45] Date of Patent: Aug. 20, 1985

[54] MOUNTING APPARATUS FOR PROCESSING LENS BLANKS

[75] Inventor: Frank D. Sorrells, Knoxville, Tenn.

[73] Assignee: Cole National Corporation, Cleveland, Ohio

[21] Appl. No.: 446,412

[22] Filed: Dec. 2, 1982

[51] Int. Cl.[3] ..... B24B 13/02

[52] U.S. Cl. ..... 51/216 LP; 51/217 L

[58] Field of Search ..... 51/58, 124 L, 216 LP, 51/234, 217 L, 106 LG, 162

[56] References Cited

U.S. PATENT DOCUMENTS

| | | | |
|---|---|---|---|
| 1,135,936 | 4/1915 | Edmondson | 51/124 L |
| 1,609,963 | 12/1926 | Robinson | 51/124 L |
| 2,286,319 | 6/1942 | Sünskes | 51/216 LP |
| 4,341,045 | 7/1982 | Sorrells | 51/216 LP |

*Primary Examiner*—Harold D. Whitehead

*Attorney, Agent, or Firm*—Fay, Sharpe, Fagan Minnich & McKee

[57] ABSTRACT

An adapter for holding a lens blank and lens block assembly in a fining and polishing apparatus includes an adapter body having a non-circular socket extending inwardly thereof from one face for receiving a correspondingly shaped projection on a lens block. A central recess in the other face of the adapter body receives a pin on a spindle pressure arm. The non-circular socket provides a reference axis corresponding to the base line for the lens block. Guide rods extend outwardly from the outer periphery of the adapter body parallel to the reference axis for cooperation with a locating rod in a fining and polishing apparatus for maintaining the proper orientation of the lens blank during processing. Apparatus for mounting lens blanks in a desired rotated position includes a plate attached to a spindle pressure arm and having a guide arm extending outwardly therefrom for pivotal movement about a vertical axis. A pointer and indicia on the upper face of the plate are provided for indicating the angular adjustment of the guide arm. A locating rod extending downwardly from the outer end portion of the guide arm cooperates with guide rods associated with the lens blank for maintaining the desired rotated orientation of the lens blank during processing.

11 Claims, 16 Drawing Figures

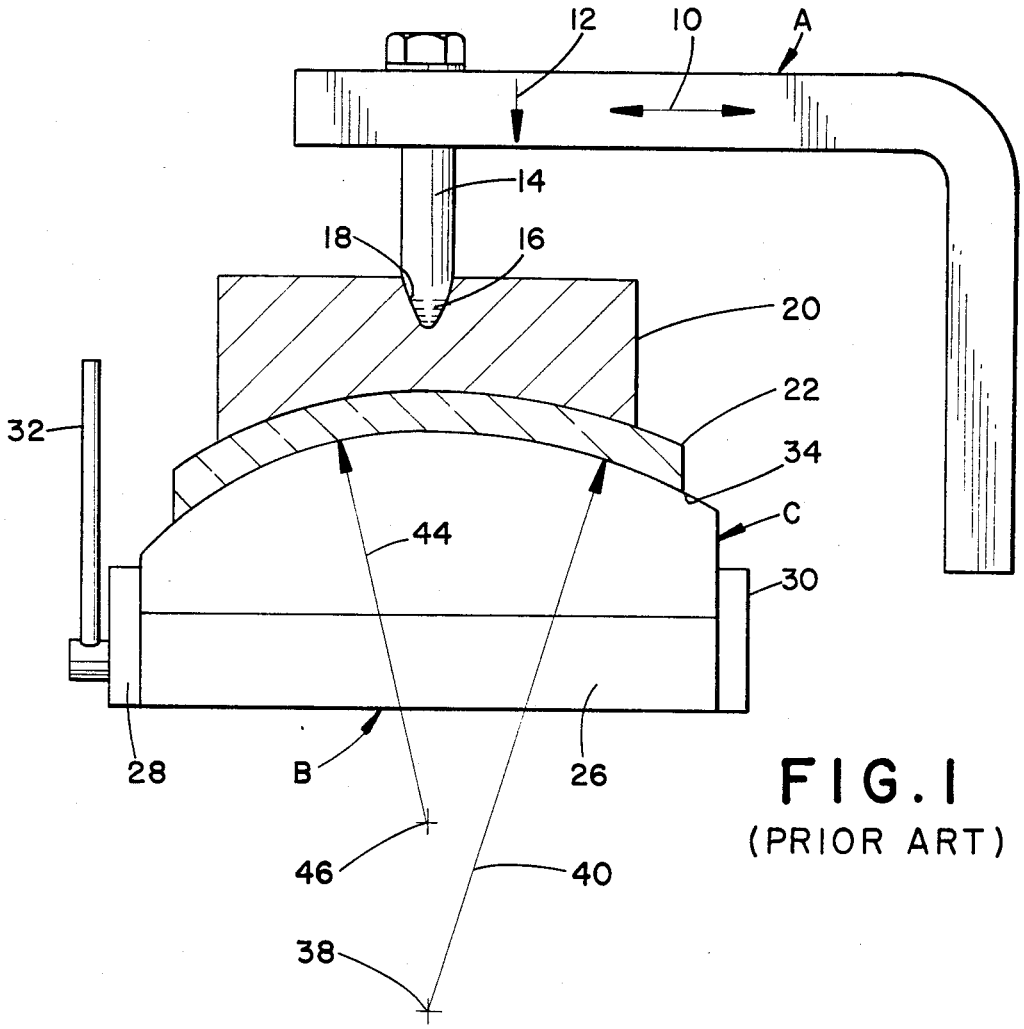
FIG. 1
(PRIOR ART)
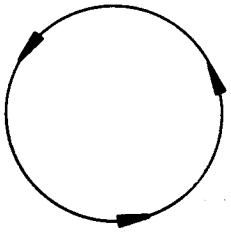
FIG. 2
(PRIOR ART)
FIG. 3
(PRIOR ART)
FIG. 4
(PRIOR ART)
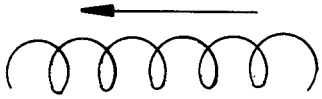
FIG. 5
(PRIOR ART)
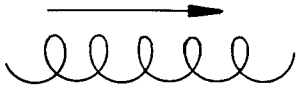
FIG. 6
(PRIOR ART)

MOUNTING APPARATUS FOR PROCESSING LENS BLANKS

BACKGROUND OF THE INVENTION

This application relates to the art of processing lens blanks and, more particularly, to fining and polishing apparatus used in processing lens blanks.

The invention is particularly applicable to processing of lenses having compound curvatures, such as toric lenses, and will be described with particular reference thereto. However, it will be appreciated that certain features of the invention have broader aspects and may be used in processing other lenses.

Toric lenses and the like are processed with fining and polishing apparatus having a pair of downwardly extending pins on the spindle pressure arm for reception in a pair of corresponding recesses in the upper face of a lens block. A generally horizontal line extending through both pins provides a reference axis for maintaining the lens blank in a desired rotated orientation during fining and polishing operations. Due to the compound motion of the lap, along with its curvature, the lens block and lens blank assembly tilts and wobbles about the pins on the spindle pressure arm during the fining and polishing operations. The use of two pins has been considered necessary for holding the lens blank against rotation and in proper alignment so that curves will not be ground off axis from the desired prescription. However, the use of two pins inhibits tilting of the lens and the lens block in a vertical plane passing through the two pins. This causes unequal loading on the lens blank and can result in incomplete fining or polishing at certain places on the lens blank, optical distortions, and thin edges. These problems may be reduced to acceptable levels by using large rigid lens blocks which occupy substantially the entire rear surface area of a lens blank to minimize deflection of such blank. The use of large lens blocks does not allow contour edging of the lens blank while the same lens block remains attached to the lens blank and it would be desirable to have a mounting arrangement which could be used with small lens blocks while minimizing distortions in the lens blank.

Accordingly, it has been considered desirable to develop a new and improved adapter arrangement for holding a lens block and associated lens blank during a fining and polishing process. The subject invention meets these needs, successfully overcomes the above noted problems and others, and is readily adapted to use in a variety of applications.

BRIEF SUMMARY OF THE INVENTION

Apparatus of the type described includes an adapter body having opposite faces, one face having a non-circular socket for receiving a correspondingly shaped projection on a lens block, and the other face having a central cavity for receiving a pin on a spindle pressure arm of a fining and polishing apparatus. The non-circular socket provides a reference axis corresponding to the base line of a lens blank for locating the adapter and the lens blank in a desired rotated position for processing of the lens blank.

Instead of using a pair of pins on the spindle pressure arm for preventing rotation of the lens blank, a guide means extends outwardly from the outer periphery of the adapter body parallel to the reference axis corresponding to the lens blank base line. Thus, a single pin can be provided on the spindle pressure arm for allowing tilting and wobbling movement of the adapter and lens blank in all directions during processing. At the same time, however, the desired orientation of the lens blank is maintained by having the guide means cooperate with locating means on the spindle pressure arm.

In one arrangement, the guide means on the adapter body includes a pair of elongated cylindrical guide rods extending outwardly from the periphery thereof substantially perpendicular to the longitudinal axis thereof on opposite sides of the reference axis corresponding to the lens block base line. An elongated cylindrical locating rod on the spindle pressure arm defines the locating means and is closely received between the guide rods for preventing rotation of the adapter body during processing of a lens blank. The apparatus for holding and orienting a lens blank includes a plate mountable to a spindle pressure arm of a fining and polishing apparatus. A laterally extending guide arm is pivotally attached to the plate for angular adjustment about a generally vertical axis. A pin extends downwardly coincidental with the vertical axis for reception in a recess in a lens blank holder. Indicating means on the upper face of the plate indicates that angularly adjusted position of the guide arm which is releasably locked in position by releasable locking means. Locating means extends downwardly from the outer end portion of the guide arm for cooperation with guide means on a lens blank holder to prevent rotation of such holder and thereby hold the lens blank in a desired orientation during fining and polishing operations. The foregoing arrangement thus makes it possible to use a single pin on the spindle pressure arm of the fining and polishing apparatus so that the lens blank and its holder may wobble in any direction without placing undue stress on the lens blank while maintaining a preselected rotated orientation of the lens blank by holding it in the desired position against rotation.

The principal object of the invention is to provide improved apparatus for processing lens blanks.

It is also an object of the invention to provide an improved adapter for use in processing lens blanks while using a single pin on a spindle pressure arm.

A further object of the invention is the provision of an improved apparatus for holding a lens blank against rotation and in proper orientation on a spindle pressure arm during processing of the lens blank.

An additional object of the invention is the provision of such apparatus which is economical to manufacture, and which is simple to operate and maintain.

Still further objects for and advantages of the invention will become apparent to those skilled in the art upon a reading and understanding of the following detailed description.

BRIEF DESCRIPTION OF THE DRAWINGS

The invention may take form in certain parts and arrangements of parts, preferred embodiments of which will be described in detail in this specification and illustrated in the accompanying drawings which form a part hereof and wherein:

FIG. 1 is a somewhat diagrammatic side elevational view of a fining and polishing apparatus with a lens and lens block shown in cross-section for clarity of illustration;

FIG. 2 is a plan view of one type of movement a lap holder experiences in a fining and polishing apparatus;

FIGS. 3 and 4 represent additional movements which the lap holder experiences;

FIG. 5 is a digrammatic representation of the compound movement for the lap holder when the movements of FIGS. 2 and 3 are combined;

FIG. 6 is a diagrammatic illustration of the compound movement which the lap holder undergoes when the movements of FIGS. 2 and 4 are combined;

DETAILED DESCRIPTION OF A PREFERRED EMBODIMENT

Figure 7:
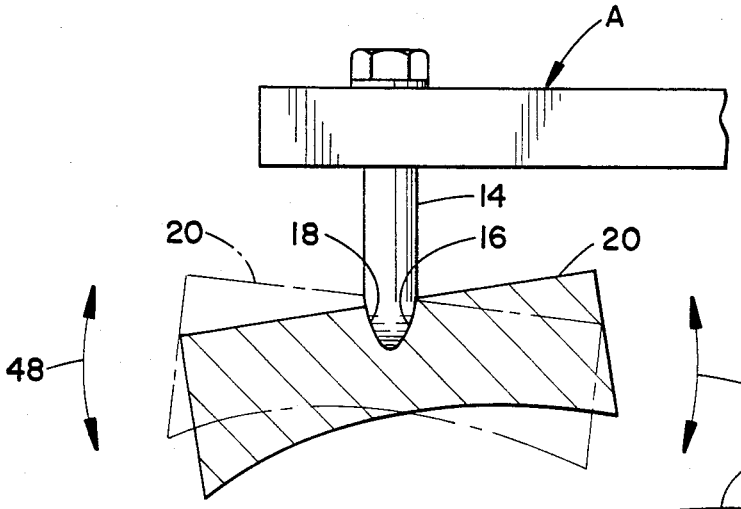
FIG. 7 (PRIOR ART)
FIG. 7 is a partial side elevational view showing a portion of a spindle pressure arm and pin with a lens block shown in cross-section and illustrating tilting or wobbling movements which may occur.

With reference to the drawings, wherein the showings are for purposes of illustrating preferred embodiments of the invention only and not for purposes of limiting same, FIG. 1 shows a spindle pressure arm A connected with a suitable mechanism in a known manner for oscillation back and forth as indicated by arrows 10, and being pneumatically biased downwardly as indicated by arrow 12. It is possible to vary the downward biasing force on spindle pressure arm A by varying the air pressure supplied to the pneumatic means which effects the biasing force in the direction indicated by arrow 12. A generally vertically downward extending pin 14 is attached to arm A adjacent the outer end portion of the horizontal extension thereof. Pin A has a generally rounded terminal end portion 16 received in a cavity 18 in a lens block 20 which is suitably attached to a lens blank 22.

A lap holder B includes a base 26 having opposed jaws 28,30 attached thereto and extending upwardly above the upper surface thereof. At least one of the jaws, such as jaw 28, is movable toward and away from jaw 30 by operation of a rotatable handle 32 in a known manner. This allows positioning of a lap C on lap holder base 26 and clamping of same thereon between jaws, 28,30 by suitable operation of handle 32.

Upper surface 34 of lap C has a suitable curvature and is commonly provided with a fining pad in a known manner for fining and polishing lens blank 22. In the arrangement shown, lap curved surface 34 is generally spherical for fining and polishing a spherical surface on lens blank 22.

A suitable electric motor drive and motion conversion mechanism causes lap holder B to orbit in a generally circular path as indicated in FIG. 2 about a point 38 shown in FIG. 1. The orbital movement of lap holder B is such that it does not remain perfectly horizontal while moving in a circular orbit, but also tips slightly to remain generally perpendicular to the radius line 40 (FIG. 1). The motion conversion mechanism also causes lap holder B to oscillate back and forth as generally indicated in FIGS. 3 and 4.

During movement of the lap holder in one direction as indicated in FIG. 3, it goes through a plurality of orbits as shown in FIG. 2. Likewise, during movement of the lap holder in an opposite direction as indicated in FIG. 4, it also goes through a plurality of orbits as generally indicated in FIG. 2. The resulting combined movement is shown generally in FIGS. 5 and 6. FIG. 5 shows the general path of movement of the lap and lap holder when the movements of FIGS. 2 and 3 are combined. FIG. 6 shows the general path of movement of the lap and lap holder when the movements of FIGS. 2 and 4 are combined.

As long as pivot radius 40 of lap holder B is substantially the same as the radius of curvature for lap upper surface 34, there are no unusual movements imparted to lens blank 22 or lens block 20. However, when the radius of curvature 44 for the upper curved surface 34 of lap C is substantially different from radius 40 and about a point 46 displaced substantially from point 38, tilting and wobbling of lens block 20 takes place about pin 14 in order that the concave surface of lens blank 22 can follow the curvature of lap C. Such tilting or wobbling movement is diagrammatically illustrated in FIG. 7 by dotted lines for lens block 20. It will be recognized that such wobbling movement can take place throughout 360 degrees around pin 14. The wobbling movement is generally indicated by arrows 48.

When a spherical lens is being processed, the wobbling movement is no problem because a single pin 14 can be used and the lens blank and lens block can be allowed to rotate around pin 14 during fining and polishing operations.

Figure 8:
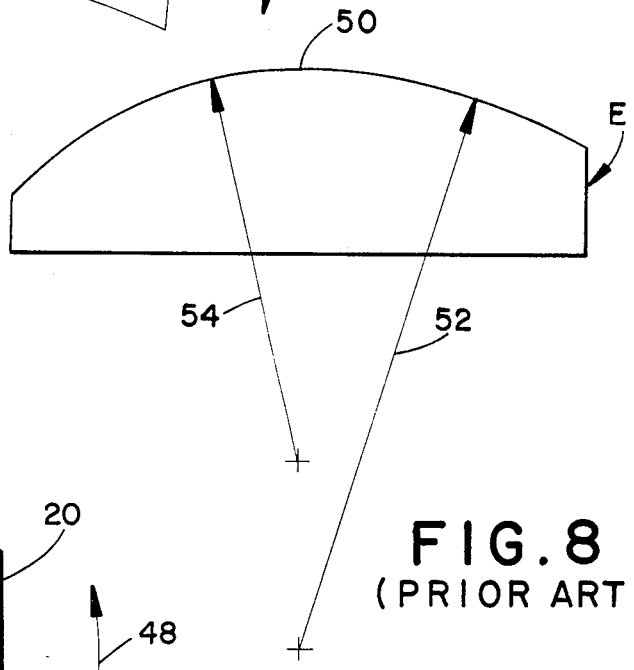
FIG. 8 (PRIOR ART)
FIG. 8 is a side elevational view of a lap having a compound curvature.

FIG. 8 shows a lap E having an outer curved surface which is curved on two different radii 52,54 with one radius 52 representing curvature in a plane perpendicular to the plane of the paper, while radius 54 represents curvature from left-to-right in the plane of the paper. With a compound or generally toric curvature of this type, it is necessary to hold the lens blank and the lens block against rotation to prevent grinding the curvature off axis from the desired prescription.

Figure 9:
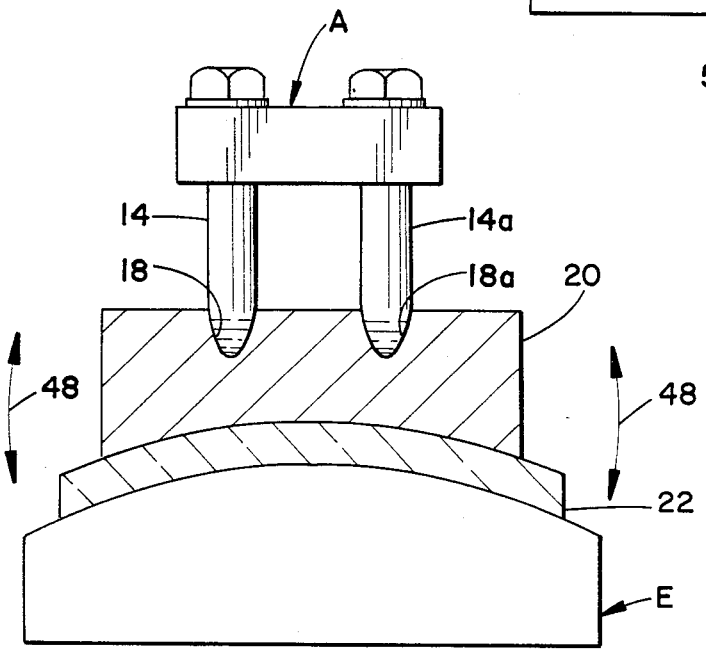
FIG. 9 (PRIOR ART)
FIG. 9 is an elevational illustration of a fining and polishing arrangement using two pins showing a lens block and lens blank in cross-section for clarity of illustration.

In order to hold the lens blank and lens block in a desirable rotated orientation during fining and polishing of the lens blank, it is common to use a pair of downwardly extending spaced-apart pins 14,14*a* as shown in FIG. 9. Such pins are received in corresponding recesses 18,18*a* in the upper face lens block 20. Thus, lens block 20 cannot rotate about a vertical axis relative to pins 14,14*a* and a desired lens base line orientation can be maintained for movement of lens blank 22 over the upper surface of lap E. With an arrangement of the type described, lens block 20 and lens blank 22 still tend to tilt and wobble as generally indicated by arrows 48 about pins 14,14*a*. Such wobbling is not a particular problem when it takes place about an axis extending through both of the pins. However, when tilting or wobbling tends to occur about a horizontal axis perpendicular to a common horizontal axis extending through both pins, such tilting or wobbling movement cannot occur and this places high stresses on the outer peripheral portions of the lens blank. When a small lens block is being used, this can result in deformation of an outer peripheral portion of the lens blank, or in optical distortions, thin edges and incomplete fining or polishing at selective locations on the lens blank.

Figure 10:
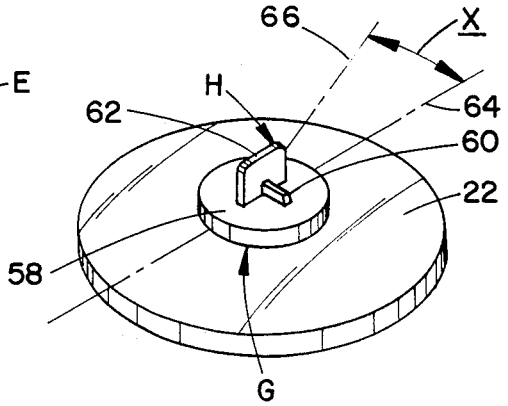
FIG. 10 (PRIOR ART)
FIG. 10 is a perspective illustration of a lens blank and a very small diameter lens block.

FIG. 10 shows a lens blank 22 attached to a lens block G of the type described in the commonly assigned U.S. Pat. No. 4,341,045, the disclosure of which patent is incorporated hereinto by reference. Lens block G includes a generally circular base 58 having a diameter substantially smaller than lens blank 22. A generally T-shaped projection H extends upwardly from lens block base 58, and includes a relatively small central leg 60 and a pronounced crossing leg 62. Lens block G is normally mounted to lens blank 22 with crossing leg 62 coinciding with lens blank base line 64, and with projection H centered on the mechanical axis of lens blank 22. It is common to rotate lens blank 22 through an angle x from base line 64 to another reference line 66 passing through the optical center of lens blank 22. This is done for grinding so-called cylindrical lenses used to correct for various types of astigmatisms or for generating toric lenses. Location of crossing projection 62 in alignment with base line 64 provides a reference axis for all future operations.

Figure 11:
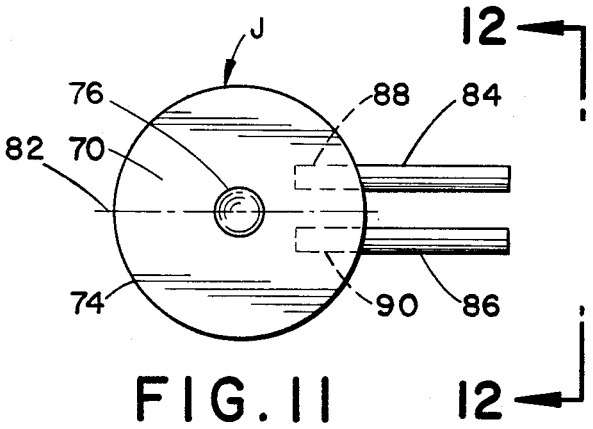
FIG. 11 is a top plan view of an adapter constructed in accordance with the present application.
Figure 12:
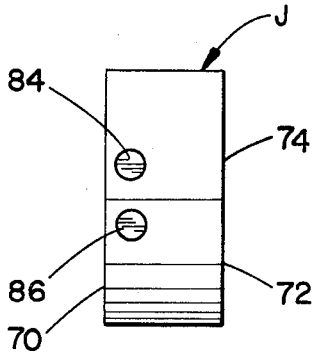
FIG. 12 is a side elevational view taken generally along lines 12—12 of FIG. 11.
Figure 13:
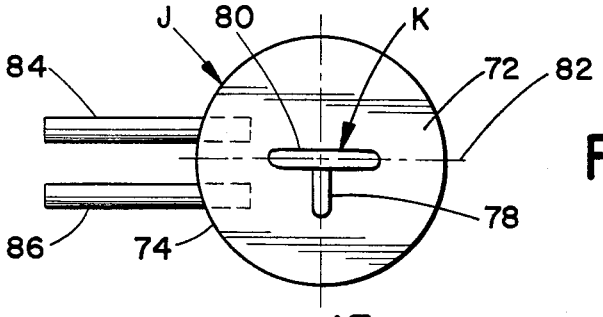
FIG. 13 is a bottom plan view of the adapter shown in FIGS. 11 and 12.

FIGS. 11–13 show a generally cylindrical adapter body J having opposite faces 70,72 and an outer periphery 74. A central recess 76 in one face 70 of adapter body J is adapted to receive a pin of the type indicated at 14 in FIG. 1. The other face 72 of adapter body J has a non-circular generally T-shaped socket K therein corresponding in size and shape to projection H on lens block G of FIG. 10. Socket K includes a central leg 78 and a crossing leg 80 having a longitudinal axis aligned with a reference axis 82 corresponding to base line axis 64 of FIG. 10. Thus, when an assembled lens blank 22 and lens block G of FIG. 10 are assembled to adapter body J by having projection H received in socket K, base line axis 64 will lie in a common vertical plane with reference axis 82.

Adapter body J includes guide means for maintaining reference axis 82 in a desired rotated orientation during fining and polishing operations on a lens blank held in the adapter. In one arrangement, the guide means includes a pair of parallel spaced-apart elongated cylindrical guide rods 84,86 extending outwardly from the outer periphery of peripheral surface 74. Guide rods 84,86 are spaced-apart from one another in a direction circumferentially of adapter body J as opposed to axially thereof. Adapter body J has a pair of bores 88,90 extending inwardly thereof for receiving guide rods 84,86 which are suitably secured in such bores.

Figure 14:
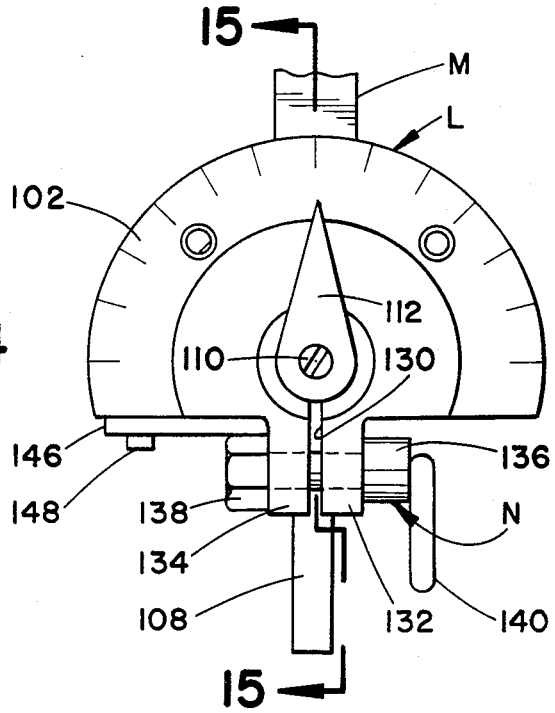
FIG. 14 is a top plan view of a plate assembly attachable to a spindle pressure arm of a fining and polishing apparatus.
Figure 15:
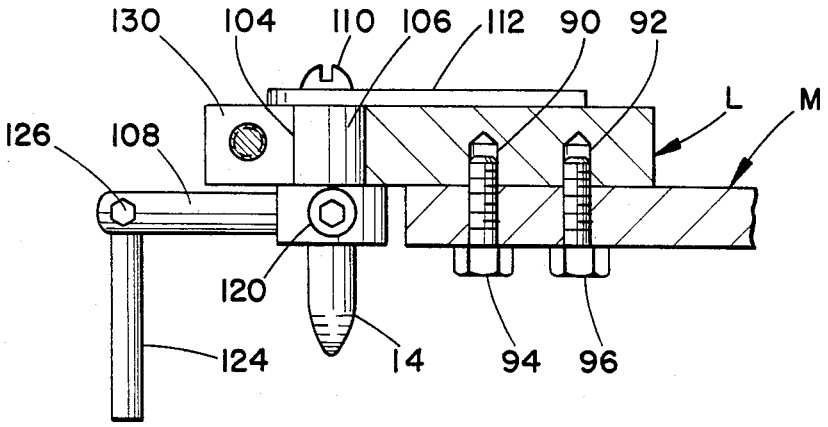
FIG. 15 is a partial cross-sectional elevational view taken generally along lines 15—15 of FIG. 14; and, FIG. 16 is a top plan view showing an adapter having lateral guide rods cooperating with a vertical locating rod.

FIGS. 14 and 15 show an improved apparatus for mounting a lens blank in a fining and polishing apparatus. A generally flat plate L has tapped bores 90,92 in the bottom face thereof for receiving bolts 94,96 which extend through suitable holes in spindle pressure arm M for fixedly securing plate L thereto. The upper surface of plate L is generally indicated by numeral 102 in FIG. 14 and has indicia thereon on an arcuate path for indicating a desired angular orientation for a lens blank. A vertical cylindrical bearing hold in plate L outwardly of spindle pressure arm M rotatably receives a shaft 106 on a laterally or horizontally extending guide arm 108. Shaft 106 is suitably centrally tapped for receiving a screw 110 for attaching a pointer 112 thereto which cooperates with indicia 102 on plate L to indicate the position of guide arm 108 from a reference base.

In general, pointer 112 cooperates with the indicia for indicating the angle x of FIG. 10 through which guide arm 108 is rotated. Shaft 106 of guide arm 108 has a socket therein on the opposite side thereof from pointer 112 to define pin holding means for receiving the upper end portion of a pin 14 which is removably locked thereto as by a set screw 120. The outer end portion of guide arm 108, which is located outwardly beyond the outer periphery of plate L, also includes a suitably vertical hole for receiving the upper end portion of locating means in the form of an elongated cylindrical locating rod 124 secured in position as by a set screw 126.

Continuing with reference to FIGS. 14 and 15, a slot 130 of substantial width extends from plate hole 104 to the outer periphery thereof between a pair of ears 132,134 shown in FIG. 14. Suitable lateral holes through ears 132,134 perpendicular to slot 130 rotatably receive a smooth shaft portion on locking means defined by clamping means N having an enlargement 136 adjacent ear 132 and having a threaded shaft portion threadably received in a nut 138 outwardly of ear 134. Once nut 138 is tightened on the threaded shaft portion of clamping means N so that further rotational movement of clamping means N by operation of manual handle 140 will tend to close slot 130, a flat keeper plate 146 is attached to plate L as by one or more screws 148 and extends behind nut 138 for preventing rotation thereof. Thus, manual rotation of handle 140 on clamp means N selectively closes slot 130 to clamp shaft 106 of FIG. 15 in plate hole 104 against rotation.

Figure 16:
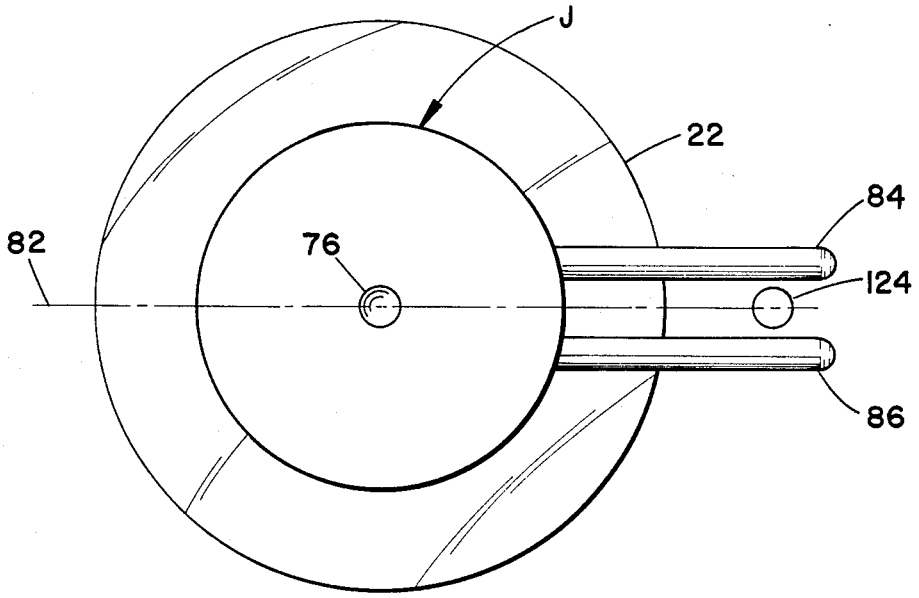

FIG. 16 provides a diagrammatic illustration of how the improved arrangements of the present application maintain proper orientation of a lens blank without inhibiting wobbling movement thereof about a pin on the spindle pressure arm of the fining and polishing apparatus. The locating means defined by downwardly extending substantially vertical and cylindrical locating rod 124 is closely received between the guide means defined by guide rods 84,86 extending outwardly from adapter body J on opposite sides of reference axis 82 corresponding to base line axis 64 of lens blank 22. Pointer 122 and guide arm 108 move in unison and loosening of clamping means N allows rotation of guide arm 108 until pointer 112 is at the desired angle on indicia 102 which may generally correspond to angle x of FIG. 10. Clamping means N is then tightened for preventing further rotational movement of guide arm 108.

When the apparatus is thereafter energized, lens blank 22 is prevented from rotating about pin 14 due to reception of locating rod 124 closely between guide rods 84,86 for maintaining lens blank 22 in a proper rotated orientation during fining and polishing thereof. Obviously, the lap block holder goes through the movements described with reference to FIGS. 2–6, and the spindle pressure arm also oscillates. However, the use of a single central recess 76 and a single pin 14 enables tilting and wobbling of the lens blank in all directions about pin 14 while rotation of same is prevented. A slight amount of slack may be provided between guide rods 84,86 and locating rod 124 so that limited tilting and wobbling movement may take place. However, the clearance is preferably such that the degree of rotational movement of lens blank 22 relative to locating rod 124, when guide rods 84,86 are in a common horizontal plane extending perpendicular to locating rod 124, is limited to approximately one degree.

Although the invention has been shown and described with reference to a preferred embodiment, it is obvious that equivalent alterations and modifications will occur to others skilled in the art upon the reading and understanding of this specification. The present invention includes all such equivalent alterations and modifications, and is limited only by the scope of the claims.

Having thus described the invention, it is now claimed:

1. An adapter for holding a lens blank and lens block assembly in a fining and polishing apparatus comprising:

an adapter body having opposite faces, a non-circular socket extending into said body from one of said faces for receiving a correspondingly shaped projection on a lens block, said socket providing a lens block base line reference axis;

guide means projecting laterally from the outer periphery of said adapter body parallel to said axis for cooperation with locating means on the fining and polishing apparatus to prevent rotation of said body and thereby maintain a desired orientation of the reference axis, said guide means including a pair of guide rods extending outwardly from the outer periphery of said body adjacent each other in a parallel spaced-apart relationship on opposite sides of said reference axis, said locating means extending between said two guide rods; and, a substantially centrally located recess extending into said body from the other face thereof and adapted for receiving an associated pin on an associated spindle pressure arm of the fining and polishing apparatus.

2. The adapter defined in claim 1 wherein said guide rods are located substantially closer to said other face of said body having said pin receiving recess therein than to said one face having said socket therein.

3. The adapter as defined in claim 1 wherein said body has a pair of parallel spaced-apart bores extending inwardly thereof from the outer periphery thereof on opposite sides of said reference axis, and said guide rods being secured in said bores.

4. The adapter defined in claim 1 wherein said guide rods are cylindrical.

5. The adapter defined in claim 1 wherein said locating means is closely received between said two guide rods.

6. The adapter defined in claim 5 wherein the degree of rotational movement of said adapter body relative to said locating means is limited to approximately one degree.

7. The adapter of claim 5 wherein said locating means comprises an elongated cylindrical rod.

8. Apparatus for holding and orienting a lens blank on a spindle pressure arm of a fining and polishing apparatus comprising:

a plate adapted for mounting to a spindle pressure arm, a laterally extending guide arm pivotally attached to said plate for angular adjustment about a generally vertical axis, a pin extending downwardly from said spindle pressure arm substantially coincidental with said axis for reception in a recess in an associated lens blank holder, indicating means on the upper face of said plate for indicating the angularly adjusted position of said guide arm, releasable locking means for releasably locking said guide arm in a desired angularly adjusted position, and locating means extending downwardly from the outer end portion of said guide arm for cooperating with guide means on said associated lens blank holder to prevent rotation of such holder and thereby hold an associated lens blank in a desired orientation during fining and polishing thereof.

9. The apparatus defined in claim 8 wherein said plate has a substantially vertical bearing hole therethrough, said guide arm being located adjacent the bottom face of said plate and having an upwardly extending shaft rotatably received in said bearing hole, said plate having a slot therethrough from said bearing hole to the outer periphery of said plate, said locking means comprising clamp means for reducing the width of said slot and thereby reducing the size of said bearing hole to clamp said shaft against rotation therein.

10. The apparatus defined in claim 8 wherein said locating means comprises an elongated cylindrical rod.

11. The adapter defined in claim 10 wherein said locating means includes a substantially vertically oriented locating rod.

* * * * *